US011644258B2

(12) United States Patent
Tasyagan

(10) Patent No.: US 11,644,258 B2
(45) Date of Patent: May 9, 2023

(54) CAPACITY INCREASING MAGAZINE EXTENSION IN SEMI-AUTOMATIC AND PUMP-ACTION HUNTING RIFLES

(71) Applicant: Bahtiyar Tasyagan, Izmir (TR)

(72) Inventor: Bahtiyar Tasyagan, Izmir (TR)

( * ) Notice: Subject to any disclaimer, the term of this patent is extended or adjusted under 35 U.S.C. 154(b) by 38 days.

(21) Appl. No.: 17/593,948

(22) PCT Filed: Oct. 28, 2019

(86) PCT No.: PCT/TR2019/050904
§ 371 (c)(1),
(2) Date: Sep. 28, 2021

(87) PCT Pub. No.: WO2021/086275
PCT Pub. Date: May 6, 2021

(65) Prior Publication Data
US 2022/0178635 A1 Jun. 9, 2022

(51) Int. Cl.
*F41A 9/72* (2006.01)
*F41A 9/63* (2006.01)

(52) U.S. Cl.
CPC .. *F41A 9/72* (2013.01); *F41A 9/63* (2013.01)

(58) Field of Classification Search
CPC ..... F41A 9/61; F41A 9/63; F41A 9/67; F41A 9/70; F41A 9/71; F41A 9/72
See application file for complete search history.

(56) References Cited

U.S. PATENT DOCUMENTS 393,653 A * 11/1888 Miller ..... F41A 9/72 42/49.01
786,798 A * 4/1905 Cottom ..... F41A 9/72 42/49.01
951,657 A * 3/1910 Pedersen ..... F41A 9/72 42/49.01
1,039,182 A * 9/1912 Parsons ..... F41A 9/72 124/52
1,587,049 A * 6/1926 Swebilius ..... F41A 9/72 42/17
1,702,221 A * 2/1929 Parsons ..... F41A 9/72 42/49.02
2,620,581 A * 12/1952 Fiorini ..... F41A 9/72 42/49.01
4,821,442 A * 4/1989 Bock ..... F41A 9/72 42/17
5,119,575 A * 6/1992 Gajdica ..... F41A 9/72 42/49.01

(Continued)

FOREIGN PATENT DOCUMENTS

FR 320178 A * 12/1902

OTHER PUBLICATIONS

International Search Report in International Application No. PCT/TR2019/050904 dated Jul. 28, 2020.

(Continued)

*Primary Examiner* — Gabriel J. Klein
(74) *Attorney, Agent, or Firm* — Phil IP Law Inc.; Karen 'Kirk' Galoyan; Narek Zohrabyan

(57) ABSTRACT

The present invention relates to a magazine extension which has been developed for use in semi-automatic and pump-action hunting rifles and which increases the magazine capacity without losing spring force by easily connecting the end of the rifle to the magazine tube.

3 Claims, 5 Drawing Sheets

(56) References Cited

U.S. PATENT DOCUMENTS

| | | | | |
|---|---|---|---|---|
| 7,779,571 | B1 * | 8/2010 | Roth | F41A 9/26 42/17 |
| 9,080,833 | B1 | 7/2015 | Williford | |
| 9,435,607 | B1 | 9/2016 | Moushon et al. | |
| 9,534,862 | B2 * | 1/2017 | McNitt | F41A 9/72 |
| 2015/0323272 | A1 | 11/2015 | McNitt | |
| 2017/0307319 | A1 * | 10/2017 | Jarboe | F41A 9/79 |

OTHER PUBLICATIONS

Written Opinion of the International Searching Authority in International Application No. PCT/TR2019/050904 dated Jul. 28, 2020.

* cited by examiner

CAPACITY INCREASING MAGAZINE EXTENSION IN SEMI-AUTOMATIC AND PUMP-ACTION HUNTING RIFLES

TECHNICAL FIELD

The present invention relates to a magazine extension which is developed for use in semi-automatic and pump-action hunting rifles. Magazine extension is capable of increasing magazine capacity without losing spring force by easily connecting it to the end of magazine tube of the rifle.

PREVIOUS TECHNIQUE

It is well-established that semi-automatic and pump-action hunting rifles are manufactured to have different ammunition capacities within specified standards. However, certain types of magazines have been manufactured for the purpose of increasing the magazine capacity of rifles in line with user demands. Magazine chambers have been extended by means of attaching extensions to the end of the magazine tube, thereby ensuring that magazines may house more ammunition.

In the state of the art, there are specific applications that allow for increasing the magazine capacity by attaching a cylindrical hollow extension tube to the end of the magazine tube. These applications, while increasing the magazine capacity, also resulted in certain problems in the rifle. For instance, these applications caused less compression to be exerted on the magazine spring, as the magazine capacity increases when the extension is attached, thereby inducing a decrease in the propulsion force. For this reason, feeding problems occurred during the operation of the rifle and further problems were experienced in transferring the ammunition from the magazine to the barrel. Using the rifle at different angles exacerbated the feeding problem even further.

In yet another known application available in the state of the art, certain attempts were made to eliminate the aforementioned problems, wherein a combination of an extension spring and a spring guide were contemplated to be used with a magazine extension. Although this application did help to eliminate the aforementioned problem, carrying and assembling the extension spring and spring guide creates another problem since magazine extension, extension spring and the spring guide are independent of each other. Losing any of these components has prevented the system from being operated. Therefore, the aforementioned solutions would not meet the demands of the users, while the other proposed solutions has raised further problems.

AIM OF THE INVENTION

The main object of the present invention is to add characteristics to the rifle, allowing it to be used in different ways (4+1/5+1/7+1) by means of increasing the magazine capacity of the rifle. Another object of the present invention is to ensure that the rifle can operate at the same efficiency as the rifle having a standard magazine capacity, although the magazine capacity is increased. Another object of the present invention is to provide a capacity-increasing system that can be easily transported and quickly assembled by forming an extension block with extension spring and spring guide therein.

Another object of the present invention is to position an extension spring and spring guide in the extension body so as to prevent the magazine spring from being affected by the volume growth, to ensure that the magazine spring operates with the same characteristics despite the growth of the magazine, thereby eliminating the problems of ammunition feed.

In accordance with these objectives, initially a tubular body is formed. The body can be produced from polymer material or metal and metal alloy material in line with user requirements.

The spring was positioned into the body and the magazine spring was fed. Thus, the rifle can operate without having any feeding problems regardless of the firing position. The spring guide can move inside the body in a void-free manner. When the extension body is attached to the rifle, it is designed to guide the magazine spring on the rifle.

The last part of the system is the body cover. After the spring guide and the extension spring are positioned inside the body, the cover is closed, and the magazine extension system is formed. The housing cover is secured to the housing by means of a cover holding pin. In this way, all the elements that make up the system are held together. Since each part is placed inside the body, it is easily carried and mounted to the rifle by the user. Additionally, the body cover prevents the parts from falling off and getting lost.

SUMMARY

In accordance with an aspect of these disclosures, there is provided a magazine extension, including: a magazine extension body which may have at least one wedge channel wherein the wedge channel has one end and may be extending into an extension body cover and the other end may be extending into a kit clearance. At least one extension spring guide which may have at least one spring guide wedge protrusion through which the extension spring guide may engage with the wedge channel and may move within the wedge channel. At least one extension spring which one end may be connected to the extension spring guide and the other end may be connected to the extension body cover.

The extension body cover may have a cover wedge protrusion which may be seated in the wedge channel. The extension body cover may also have at least one cover pin hole overlapping with retaining pin hole of the extension body and may be connected with the retaining pin hole by passing a retaining pin therethrough.

The extension spring guide may have on the front part a magazine spring assembly protrusion which may be inserted into the main magazine spring and may have on the rear part of the extension spring guide an extension spring centering slot, wherein the extension spring may be seated.

REFERENCE NUMBERS

1. Magazine Tube
2. Main Magazine Spring
3. Magazine Cover
4. Magazine Extension Body
5. Extension Spring Guide
6. Extension Spring
7. Extension Body Cover
8. Retaining Pin
9. Wedge Channel
10. Body Notches
11. Retaining Pin Hole
12. Running Clearance
13. Kit Clearance
14. Spring Guide Wedge Protrusions
15. Magazine Spring Assembly Protrusion
16. Extension Spring Centering Slot
17. Cover Wedge Protrusions
18. Cover Pin Hole
19. Interconnection Kit

DETAILED DESCRIPTION

The present invention relates to a magazine extension and is intended to increase the available magazine capacity.

Figure 10:
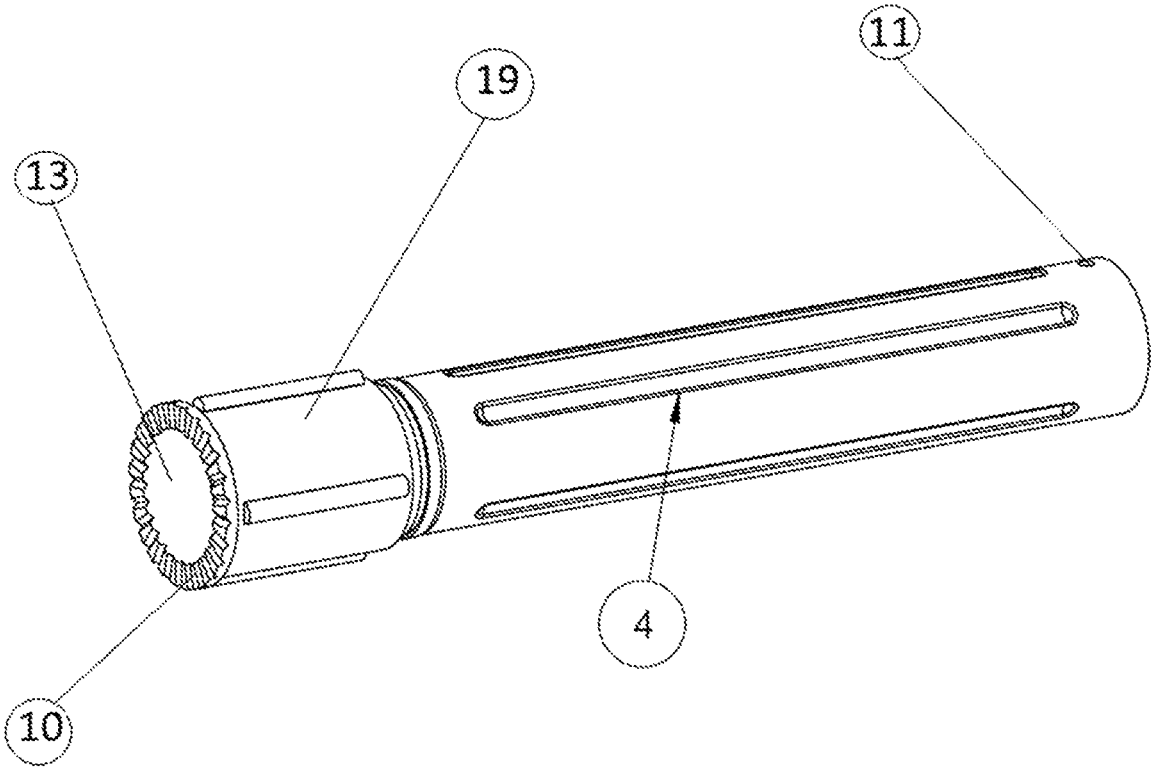
FIG. 10: Side perspective View of Magazine Extension Body
Figure 11:
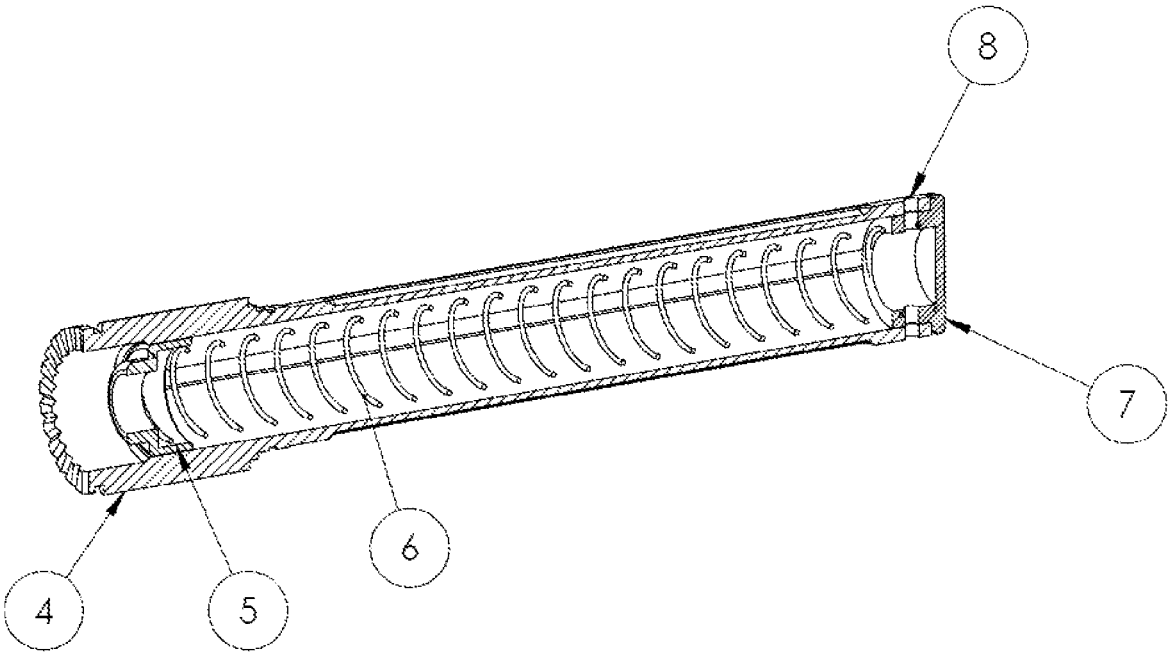
FIG. 11: Cross-sectional View of Magazine Extension Body
Figure 12:
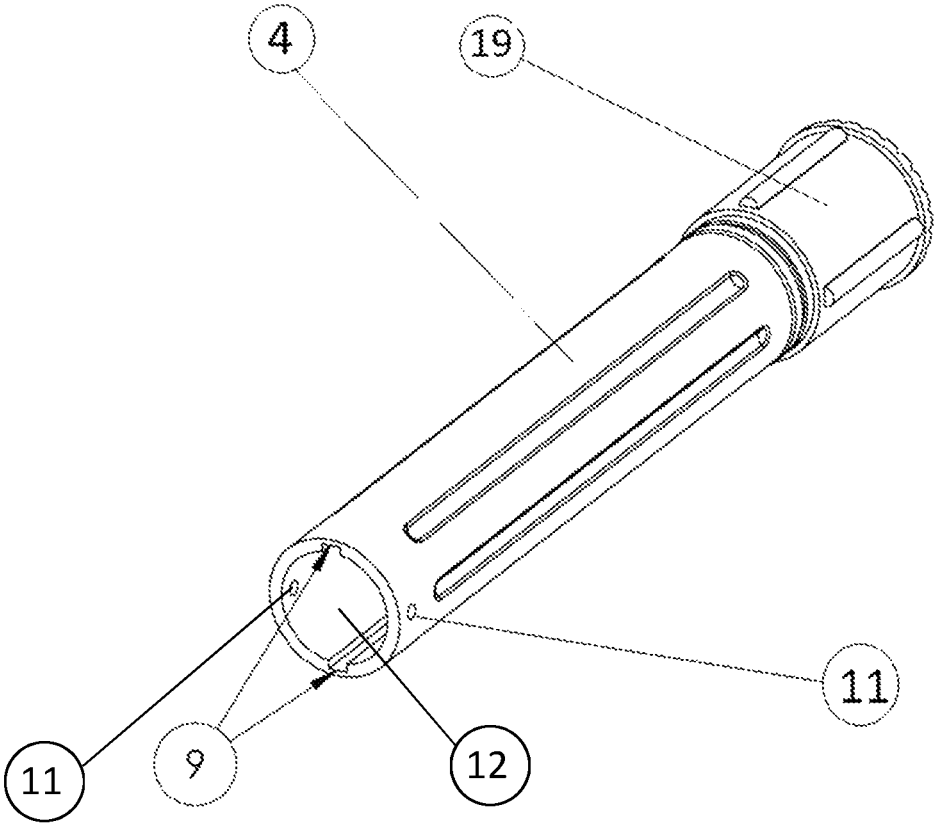
FIG. 12: Perspective view of Magazine Extension Body Wedge Channels

In FIG. 12 the magazine extension body (4) is shown (also shown in FIGS. 10, 11). The magazine extension body (4) is cylindrical and has a running clearance (12) in which an extension spring guide (5) and an extension spring (6) (shown in FIG. 11) are positioned. Two wedge channels (9) run through the whole length of the magazine extension body (4).

Figure 2:
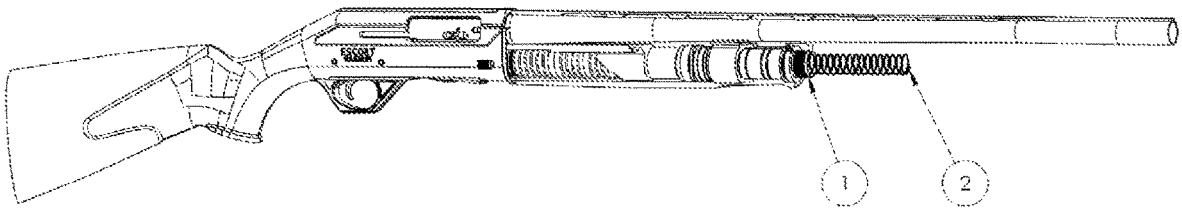
FIG. 2: View of the Magazine Tube and Magazine Spring Position
Figure 3:
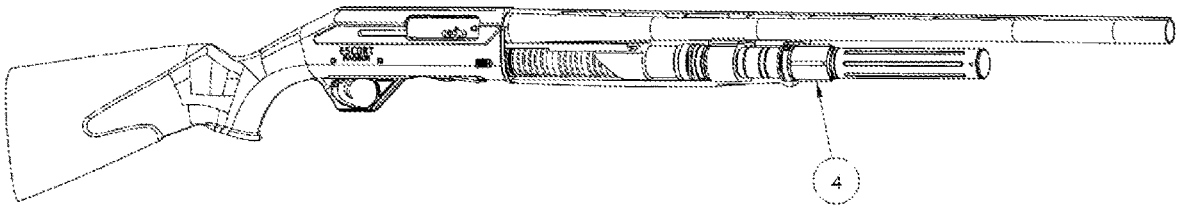
FIG. 3: General View of the Hunting Rifle with Magazine Extension Attached
Figure 4:
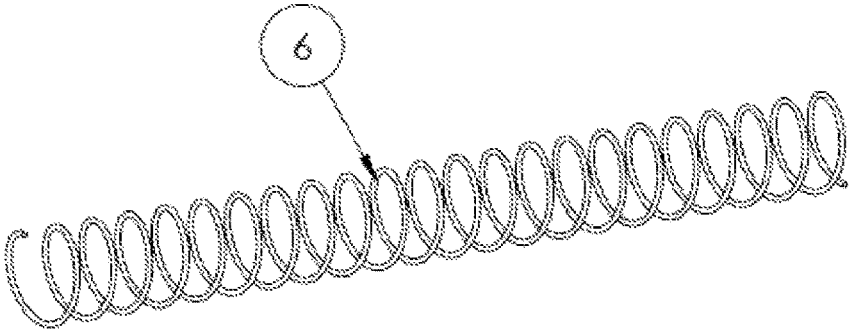
FIG. 4: View of the Extension Spring
Figure 7:
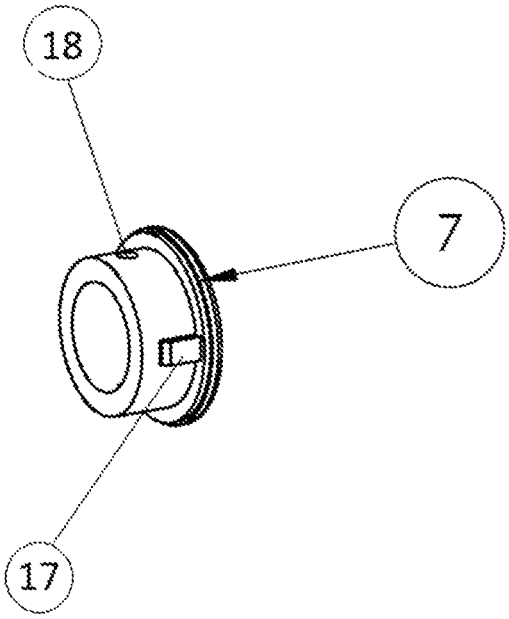
FIG. 7: Front perspective view of Extension Body Cover

At one end of the magazine extension body (4), there is a screwed interconnection kit (19) for mounting to the magazine tube (1) (shown in FIG. 2). Body notches (10) (shown in FIG. 10) are formed to provide fixation when the interconnection kit (19) is connected to the magazine tube (1). At the other end of magazine extension body (4), there are retaining pin holes (11) in which the extension body cover (7) (shown in FIGS. 11, 8, 7) is fixed through the retaining pin (8) (shown in FIGS. 11, 9). Magazine extension body (4) may be formed through injection molding of polymer material by chip-free production and by machining from metal and metal alloy materials.

Figure 5:
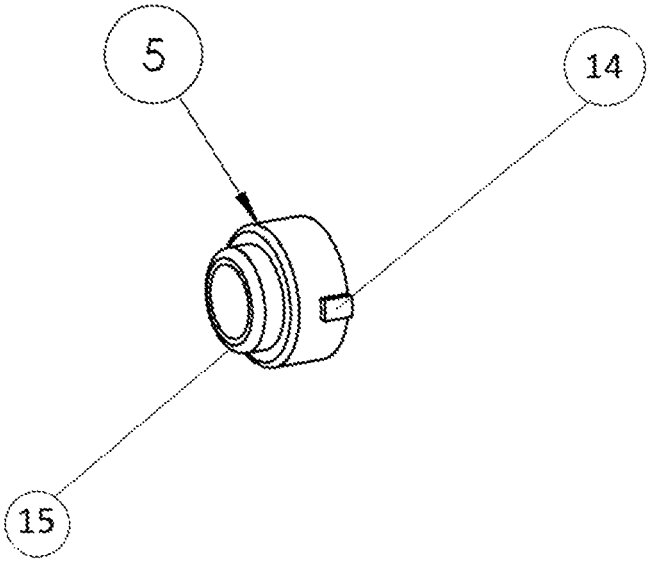
FIG. 5: Front perspective view of Extension Spring Guide
Figure 6:
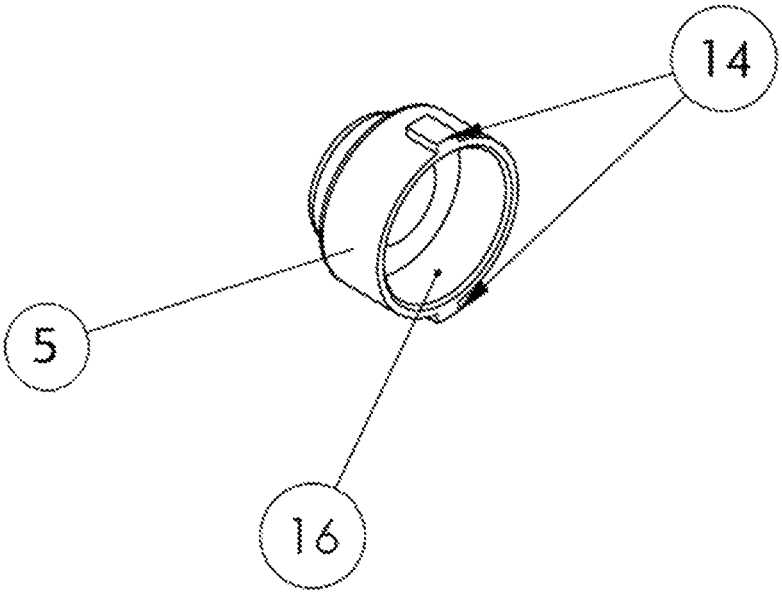
FIG. 6: Rear perspective view of Extension Spring Guide

In FIG. 5 the other main element that constitutes the magazine extension, the extension spring guide (5), is shown. The extension spring guide (5) with the spring guide wedge protrusions (14) has the shape of cylindrical bushing. At one end there is a magazine spring assembly protrusion (15) that gets seated into the magazine spring (2) (shown in FIG. 2), and provides guidance for main magazine spring (2), at the other end there is an extension spring centering slot (16) (shown in FIG. 6) in which the extension spring (6) is seated. The extension spring guide (5) transfers the power from the extension spring (6) to the main magazine spring (2). Instead of forming a single, long and weak main magazine spring (2), the ammunition becomes ready for firing by being fed with the extension spring (6) of the main magazine spring (2) in the present system. The extension spring guide (5) may also be made of a desired material like the magazine extension body (4).

The extension spring (6) is in the form of a compression spring of sufficient length and diameter to feed the existing main magazine spring (2).

Figure 8:
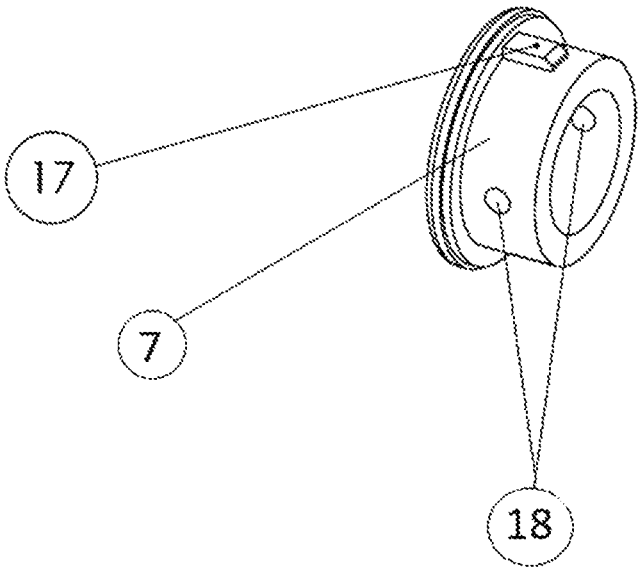
FIG. 8: Side perspective View of Extension Body Cover
Figure 9:
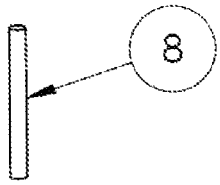
FIG. 9: View of Extension Body Cover Retaining Pin

In FIG. 8, another main element of the present invention, the extension body cover (7) is shown. The extension body cover (7) is in the form of a capped bushing or a column head. There are cover wedge protrusions (17) on said extension body cover (7). There are cover pin holes (18) which make it possible to secure said extension body cover (7) connected to the magazine extension body (4). Securing is carried out by inserting the retaining pin (8) through the retaining pin holes (11) and the cover pin holes (18) overlapping, i.e. aligning, with the engagement of the cover wedge protrusions (17) in the wedge channel (9).

The operating principle of the magazine extension according to the present invention is as follows:

Initially, the extension spring guide (5) is positioned inside the magazine extension body (4). The extension spring guide (5) is inserted into said running clearance (12) by inserting the spring guide wedge protrusions (14) into two wedge channels (9) of the magazine extension body (4). The magazine spring assembly protrusion (15) faces the running clearance (12). The spring guide wedge protrusions (14) of the extension spring guide (5) are prevented from protruding out of the magazine extension body (4) based on the end of the wedge channels (9) in the running clearance (12) with the interior of the magazine extension body (4).

The extension spring (6) is then pushed onto the extension spring guide (5) from the running clearance (12) formed in the magazine extension body (4). Thus, one end of the extension spring (6) fits into the extension spring centering slot (16) (shown in FIG. 6) of the extension spring guide (5). The other end of the extension spring (6), is held by the extension body cover (7), which is connected to the magazine extension body (4). The cover wedge protrusions (17) fit into the wedge channels (9) and the retaining pin (8) is passed through the retaining pin hole (11) to secure it. The cover wedge protrusions (17) ensure the alignment of the cover pin hole (18) and the retaining pin hole (11). Thus, when the retaining pin (8) is passed through the retaining pin hole (11), said retaining pin (8) passes through the cover pin hole (18) (shown in FIG. 11). By inserting the retaining pin (8), the magazine extension is formed according to the present invention.

Figure 1:
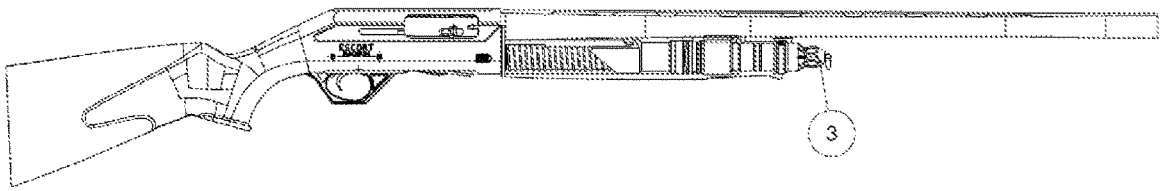
FIG. 1: View of the Hunting Rifle without Magazine Extension

In order to connect the magazine extension according to the present invention to the magazine tube (1) which is shown in FIG. 2, the magazine cover (3) on the rifle shown in FIG. 1 is initially removed. After the removal of the magazine cover (3), the main magazine spring (2) extends slightly out from the magazine tube (1). This protruding main magazine spring (2) is aligned in order to fit into the kit clearance (13) of the interconnection kit (19). Thus, the main magazine spring (2) automatically engages with the magazine spring assembly protrusion (15) at the end of the extension spring guide (5). The magazine tube (1) fits into the interconnection kit (19) through the kit clearance (13). Thus, the attachment of the magazine extension to the rifle is completed.

The body notches (10) in the interconnection kit (19) provide full attachment to the magazine tube (1). Thus, in any jolt, unwanted movement of the interconnection kit (19) and the magazine extension body (4) connected to said interconnection kit (19) is prevented.

The invention claimed is:

1. A magazine extension, comprising:

a. a magazine extension body having at least one wedge channel wherein the wedge channel has one end extending into an extension body cover and the other end extending into a kit clearance;

b. at least one extension spring guide having at least one spring guide wedge protrusion through which the extension spring guide engages with the wedge channel and moves within the wedge channel;

c. at least one extension spring with one end connected to the extension spring guide and the other end connected to the extension body cover; and d. wherein the extension body cover has a cover wedge protrusion seated in the wedge channel.

2. The magazine extension of claim 1, wherein the extension body cover having at least one cover pin hole overlapping with a retaining pin hole of the extension body and connected with the retaining pin hole by passing a retaining pin therethrough.

3. The magazine extension of claim 1, wherein the extension spring guide having on the front part a magazine spring assembly protrusion inserted into a main magazine spring and having on the rear part of the extension spring guide an extension spring centering slot wherein the extension spring is seated.

* * * * *